United States Patent [19]

Raeder

[11] 4,092,503

[45] May 30, 1978

[54] PUSH BUTTON SWITCH OR KEYBOARD ASSEMBLY HAVING FLEXIBLE WIRE CONTACTS

[76] Inventor: Johan Nils Eskil Raeder, Box 347, 123 03 Farsta, Sweden

[21] Appl. No.: 751,824

[22] Filed: Dec. 17, 1976

[30] Foreign Application Priority Data

Dec. 22, 1975 Sweden ..... 7514507

[51] Int. Cl.[2] ..... H01H 13/70; H01H 9/16

[52] U.S. Cl. ..... 200/5 A; 200/159 A; 200/276; 200/314

[58] Field of Search ..... 200/5 A, 159 R, 159 A, 200/276, 5 R, 314

[56] References Cited

U.S. PATENT DOCUMENTS

| | | | |
|---|---|---|---|
| 996,303 | 6/1911 | Wilhelm | 200/159 A |
| 2,835,754 | 5/1958 | Lewis | 200/276 |
| 3,433,914 | 3/1969 | Ericsson | 200/159 A |
| 3,773,996 | 11/1973 | Sharf | 200/276 X |
| 3,920,943 | 11/1975 | Lapointe | 200/276 X |
| 3,927,284 | 12/1975 | Anderson | 200/276 X |
| 3,979,571 | 9/1976 | Var Benschoten | 200/276 X |
| 4,002,873 | 1/1977 | Lewandowski | 200/314 |
| 4,016,388 | 4/1977 | Golbeck et al. | 200/314 |
| 4,017,700 | 4/1977 | West | 200/314 |

*Primary Examiner*—James R. Scott
*Attorney, Agent, or Firm*—Pollock, Vande Sande & Priddy

[57] ABSTRACT

A push button having a housing supporting therein a key member actuatable between an initial position and an enabled position. Inside the body a pressure spring is located for resetting the actuated key member to the initial position when pressure on the key member ceases. The spring is provided with an elongated portion which is movable in response to actuation of the key member and the elongated then engages an electrical contact member supported adjacent to the elongated portion of the spring in order to allow current to flow through the spring.

14 Claims, 19 Drawing Figures

PUSH BUTTON SWITCH OR KEYBOARD ASSEMBLY HAVING FLEXIBLE WIRE CONTACTS

FIELD OF THE INVENTION

The present invention relates to a push button having a key located in a housing, which key is actuatable between an initial position and an enabled position in opposition to a pressure spring. The invention also comprises a key set having a number of such press buttons.

The push button of this invention is particularly useful on telephone sets where it is important to a push button which has few and simply built parts but which is able to operate faultlessly. It is essential in such an application that the actuation of the push button can be attained by a predetermined amount of pressure and that the enabled position be distinct from the inactuated condition.

The present invention also includes a key set for use on telephone sets. The requirement of such a key set is that the push buttons be actuated by small and distinct actuating movements but with involuntary actuation of the buttons being prevented to the largest possible extent, despite the limited space for the key set.

A further object of the invention is to provide a push button which is useful as a modular unit with variable outer sizes. A still further object is to provide a push button structure which permits the attachment of a light emitting diode inside the button for indicating the actuated state of the button.

SUMMARY OF THE INVENTION

Described briefly, the push button according to the invention is characterized in that the button restoring spring is provided with an elongated portion which is movable in response to button actuation and interacts with a at least one contact member supported adjacent to the elongated member. The principal features of the key set of the invention are that the elongated member of the pressure spring in each button interacts with elongated contact members belonging to the key set and common to two or more buttons of the key set.

BRIEF DESCRIPTION OF THE DRAWINGS

The invention is illustrated by the way of example in the accompanying drawings in which.

DESCRIPTION OF THE PREFERRED EMBODIMENT

Figure 1:
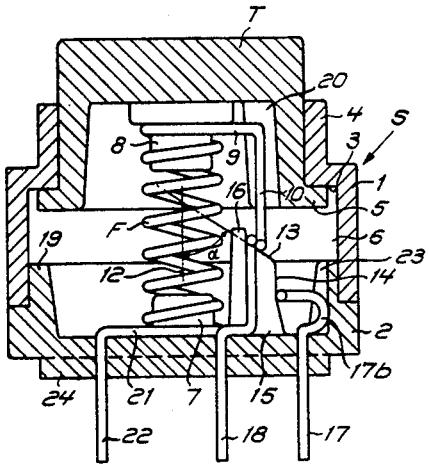
FIG. 1 is a side view in cross-section of a first embodiment of the push button.

FIG. 1 shows that the exterior of the push button has the form of a solid unit, which comprises a housing S having an upper part 1 and a lower part 2. The upper part of the housing at the top extends inwardly to provide an inner shoulder 3 and terminates with a vertically extending edge 4, which encloses a recess in the body. The key member T is located in the recess. In its lower part, the key member is provided with an outwardly directed flange 5. The housing defines a space 6 in which a helical compression spring F is located. The spring is shown as having a generally cylindrical outline, but it may instead have a frusto-conical form if desired. The spring F is attached to the housing via a first attachment element 7, which extends upwardly from the inner bottom surface of the lower part 2, and to the key T via a second attachment element 8 which extends downwardly from the inner surface of the key member. These attachment elements may have the shape of projecting cylindrical pins, the outside diameters of which substantially correspond to the inner diameter of the pressure the spring F.

Because of its location, spring F can force the key upwardly so that the flange of the key member is forced against the shoulder 3 inside the body in the initial position shown in FIG. 1.

Figure 2:
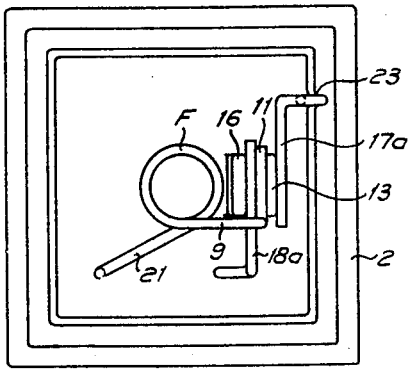
FIG. 2 is a plan view of the push button of FIG. 1 with the upper casing members 1 and 4 removed.

Spring F is provided with an elongated section having a first portion 9 which moves with key T when it is actuated, a second portion 10, and a third portion 11 (see FIG. 2). The first portion extends normal to a plane, which crosses the center axis 12 of spring F and extends perpendicular to the plane of the drawing of FIG. 1. The second portion 10 is connected to the first portion and extends substantially perpendicular in relation to the latter and substantially parallel with the center line 12 of the pressure spring. The third portion 11 is connected to the second portion and extends perpendicular not only to the second portion but also to the first portion. The second portion is provided with a length which corresponds to half the length of the spring when the key member is in the position has a length which shown in FIG. 1. The first portion is three-fourths of the length of the second portion, counted from the mentioned plan.

Via the third portion 11, spring F interacts with a surface, which in FIG. 1 is shown interrupted and having an upper part-surface 13 and a lower part-surface 14. The surface is positioned on a support 15 which is attached to the lower housing part 2 and extends upwardly from the inner bottom surface of the latter. The transition between the parts of the broken surface is via a radius, and the mentioned part-surfaces can also be smoothly curved. The upper part-surface 13 forms a comparatively larger angle $\alpha$ in relation to the center line 12 of spring F. The part-surface 14 is substantially parallel with the center line 12, but may extend at a small acute angle in relation to the same. The part-surfaces 13 and 14 having a breadth which substantially corresponds to the length of the third portion 11. The device 15 is also provided with a stop 16 which allows the portions 9–11 to be pre-stressed in a direction toward the mentioned stop 16.

At the lower part of the part-surface 14 a first contact member 17 is positioned, and at the upper part of the part-surface 13 a second contact member 18 is arranged. The mentioned contact members are attached to the housing and extend through the lower part 2 of the housing. In the initial position of the key member, spring F lies close to the second contact member via the third portion 11.

The key member also having an actuated position in which the key T is pushed downwardly by means of a manual force so that flange 5 of the key abuts an inner shoulder 19 inside the body. As the key is depressed the third portion 11 of spring F slides downwardly over the part-surfaces 13 and 14 and engages with the first contact member 17. The designs of the part-surfaces 13 and 14 are so chosen that they, together with the portions 9–11, ensure that the key T is actuatable by means of a manual force having a predetermined value.

The elongated spring section 9–11 is guided via sections on the mentioned first and second portions in a recess 20 located in the key. The mentioned recess 20 extends in the direction of actuation the key member.

Spring F is provided at its outer end with a section member having a fourth portion 21 and a fifth portion 22. The portions 9 and 21 of the pressure spring are arranged in planes which are parallel with each other and displaced in relation to each other from the angular point of view, as shown in FIG. 2. The portion 22 is parallel with portion 10 and serves as a contact stud. In such a way, the spring F has not only the function of action as a resilient member but also as a current conducting member which conducts current via portion 22 to or from any of the first and second contact members.

The first and second contact members 17 and 18 are provided with extensions which ensure that the interaction between the contact members and the portion 11 of the spring F is enlarged. In FIG. 2 the part of the contact member 17 which interacts with portion 11 is designated 17*a*. The corresponding part of the contact member 18 is designated 18*a*. The attachment part 17*b* of the first contact member is located in the recess 23 inside the body. A control opening function is attained at the second contact member 18 and a contact closure function at the first contact member 17 upon actuation of the push button. The obtained unit according to FIGS. 1 and 2 has a square horizontal cross-section with three terminal connections; the contact members 22 of the spring and those parts of the first and second contact members 17 and 18 which protrude from the body. The key is guided via its outer surface on the inner wall of the vertical protruding part 4, so the tilting tendency of the key member caused by the attaching of the elongated member against the part-surfaces 13 and 14 is counteracted. The pressure spring is made of material which allows both the spring function and the current conducting function, and can, for example, be made of spring steel or silver steel. The first and second contact members can be plated and/or be made of material such as silver wire, silver steel, etc. The unit can be built for assemblage on a circuit card or for attachment via a specific lower edge 24 at the lower part 2 of the housing. The spring may have a wire diameter of 0,3 – 0,6 mm.

Figure 3:
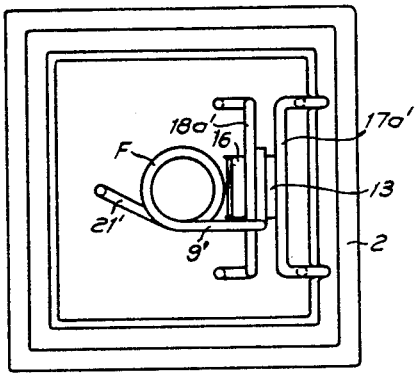
FIG. 3 is a plan view of the push button of a second embodiment also with the upper casing members removed as in FIG. 2.
Figure 5:
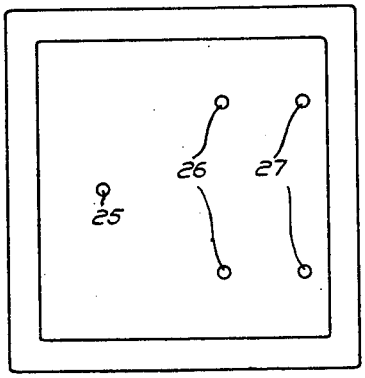
FIG. 5 is a bottom view of the push button of FIG. 3.

The structures and the attachments of the contact members, as well as the positions of the contact members, connecting terminals and the portions of the pressure spring, can be varied and an example of this is shown in FIG. 3 where each contact member, in principle, is provided with two connecting terminals or contact parts instead of only one. Furthermore, the portions 9' and 21' have been displaced from the angular point of view so that the terminals protruding from the housing have been changed relative to the pressure spring. FIG. 5 shows the unit from below and the positions of the different recesses in the lower side of the housing. Thus, the recesses of the contact members of the pressure spring have been designated 25. The recesses of both devices have been designated 26 and 27, respectively.

Figure 4:
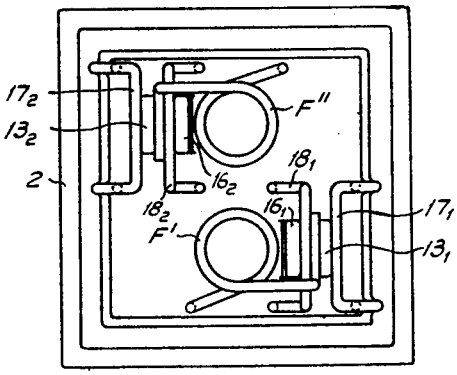
FIG. 4 is a plan view of the push button of a third embodiment again with the upper casing members removed as in FIGS. 2 and 3.
Figure 6:
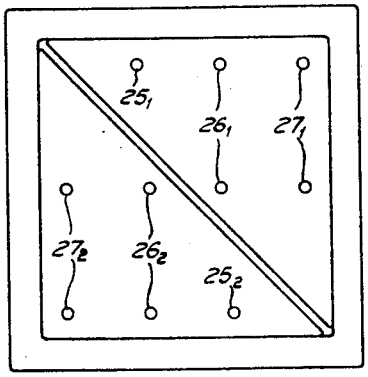
FIG. 6 is a bottom view of the push button of FIG. 4.

Inside each unit the pressure spring and its associated elements are duplicated as shown in FIG. 4 where one of the springs is designated F' and the other spring F''. The various other elements 13, 16-18 of FIG. 1 have been shown in this FIG. 4 but with appropriate subscripts for the separate switch parts. Also, in this case, the contact members have double contact terminals, but can, of course, be made with single terminals. FIG. 6 shows the terminals at the bottom side of the housing in the embodiment according to FIG. 4.

Figure 7:
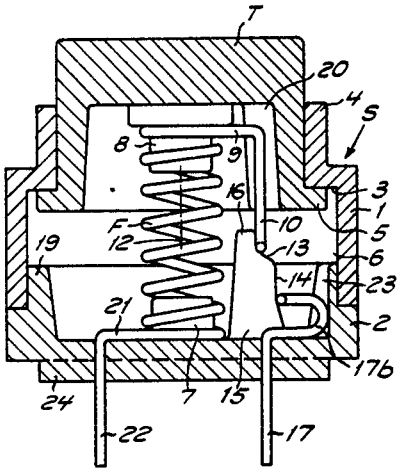
FIG. 7 is a plan view in cross-section of a fourth embodiment of the invention.

FIG. 7 shows in principle the same embodiment as FIG. 6, but with the difference that the second contact member is removed. Also, in this case, the unit has a miniature size and a horizontal cross-section of about 17×17 mm. The overall height is about 16 mm.

Figure 8:
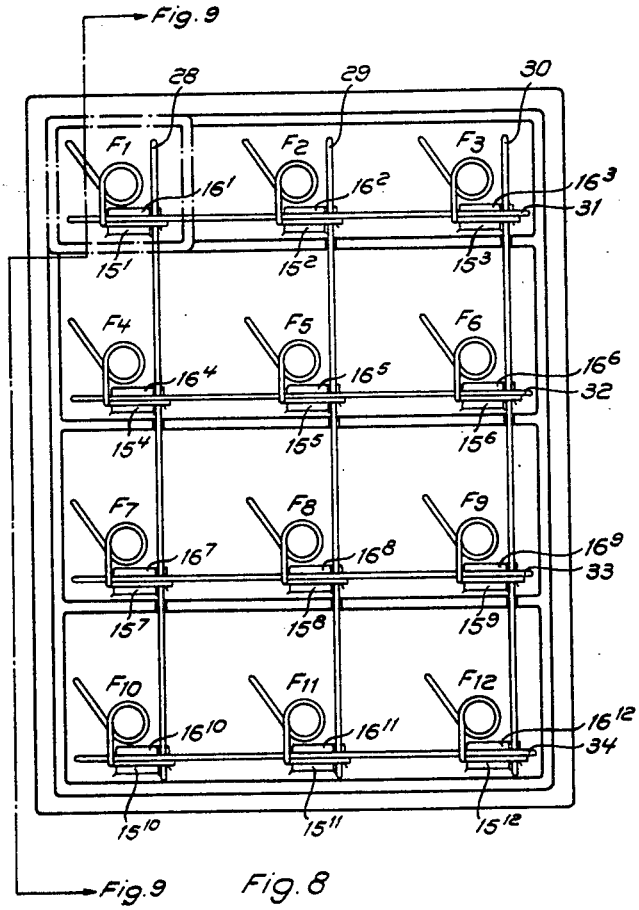
FIG. 8 is a plan view of structural parts in a key set using the invention.
Figure 9:
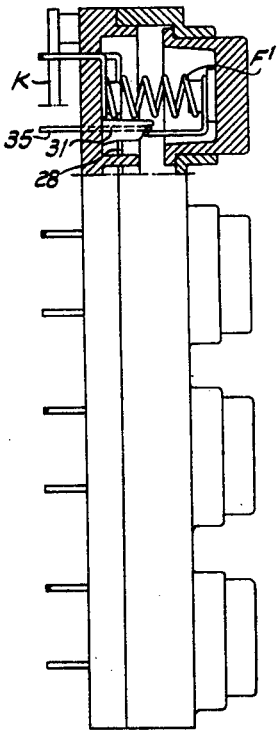
FIG. 9 is a side view, partly in cross-section, of the key set of FIG. 8 taken along the section line 9-9.

A key set having a number of buttons of the type described above for effecting selected circuit conditions relative to a printed circuit board K is shown in FIGS. 8 and 9; 10 and 11. The buttons are arranged in rows and columns. The last mentioned drawing figures illustrate a key set for a telephone set where the key set is characterized by very small outer sizes (52 × 68 × 20 mm). In FIG. 8 the pressure buttons are arranged in rows and columns. The buttons are represented by their pressure springs F1, F2 . . . F12, which are supported by protuberances $15^1$, $15^2$ . . . $15^{12}$. Elongated first contact members 28, 29 and 30 are arranged for the buttons in each column. The mentioned elongated contact members are wires formed of silver steel or other plating material. Elongated second contact members 31, 32, 33 and 34 are adapted in a corresponding way for the buttons in each row. The elongated second contact members cross the first elongated contact members at right angles so that a matrix pattern is obtained, in which the push buttons are located at the crossing points of the elongated contact members. The elongated second contact members are also made of silver steel or the corresponding.

The elongated first contact members 28, 29, 30 extend adjacent the short side of the vertical arising devices $15^1$, $15^2$ . . . $15^3$. The last mentioned devices are provided with recesses, in which the elongated first contact members are supported. The elongated first contact members extend also through recesses in partition walls between the different buttons. The elongated first contact members extend in the breadth direction of the devices $15^1$, $15^2$ . . . $15^{12}$ and are urged toward the upper parts of the stops $16^1$, $16^2$ . . . $16^3$ of the latter devices in order to make it possible that the elongated members of the pressure springs can be pre-stressed toward the stops of the devices. In such a way, the elongated first and second contact members cross each other on different levels.

The first and second contact members have the form of a clamp, the legs 35 (FIG. 9) of which are used as connection points. Like the push button described above, each push button of the key set is made with an actuating movement for the key member of about 2,5 mm. The contact interaction with the current elongated first contact members will then start after about 2,0 of movement mm and effect a good contact function. By reason of the fact that interaction takes place at the outer parts of the third portion of the elongated member of the spring, a good contact friction between the contact making surfaces is effected.

Figure 10:
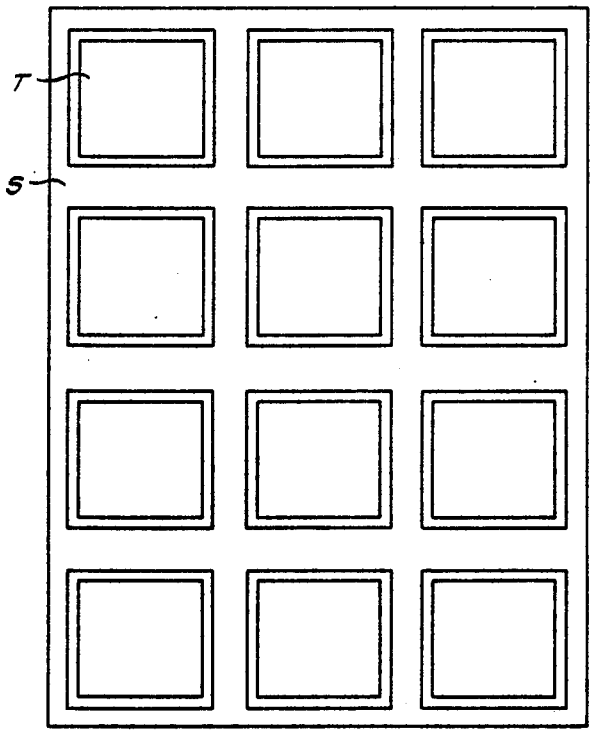
FIG. 10 is a plan view of a brief outline of the key set.
Figure 11:
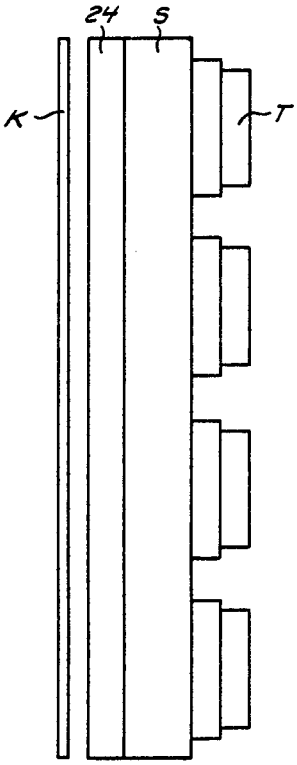
FIG. 11 is a side view of the key set of FIG. 10.

FIG. 10 shows from above the arrange of the push buttons of the key set. FIG. 11 shows the key set according to FIG. 10 from the side.

Figure 12:
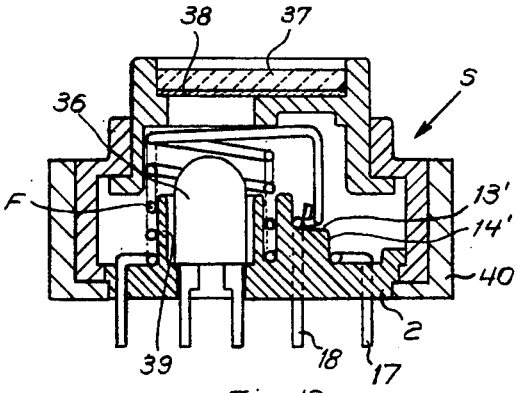
FIG. 12 is a plan view and cross-section, of a fifth embodiment of the push button.
Figure 13:
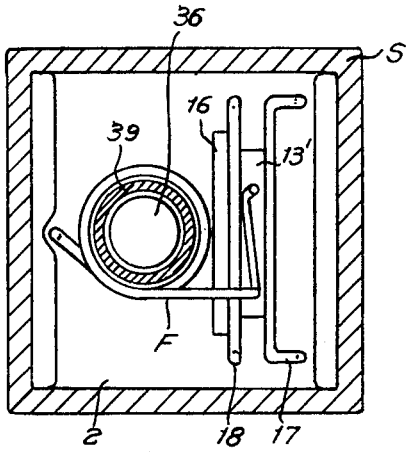
FIG. 13 is a plan view in cross-section of the push button of FIG. 12 but with member 40 of FIG. 12 removed, and FIGS. **14*a*–16*b* are different vertical and horizontal views of the spring used in the push button.

FIG. 12 shows an embodiment in which a known light emitting diode 36 is located inside the spring F in order to indicate the enabled or initial condition of the button. The diode is arranged in a recess in the lower part 2 of the housing S and is attached to a circuit card (not shown) below the button. The diode is attached to the card by welding or the like. The button has on the key member a translucent or transparant member 37. Adjacent to this latter member 37 a sign 38 can be located. The member 37 is removable, like the sign, so that the diode can be applied afterwards from above if desired. The housing S also has a combined guiding and protecting part 39 for the light-emitting diode. The part-surfaces 13' and 14' are substantially right-angled to each other and the part-surface 13' is substantially horizontal or slaned by only a few degrees.

The push button of this invention is intended to be used as modular unit in a key set. The button can be made with different outer sizes by means of a frame which can be thread onto the outer surface of the button. The button and the key set are made principally of plastic or the like.

Figure 14A:
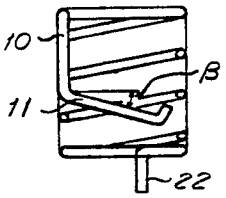
FIG. 14*b* is a plan view of the spring sham in elevation in FIG. 14*a***, and the remaining pairs of figures are similarly related.
Figure 15A:
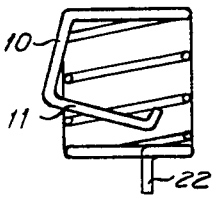
Figure 16A:
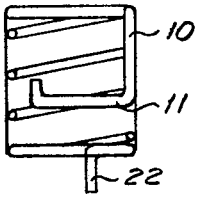
Figure 14B:
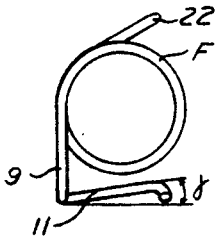
Figure 15B:
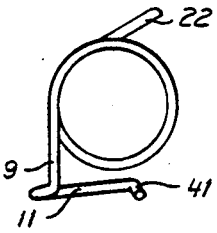
Figure 16B:
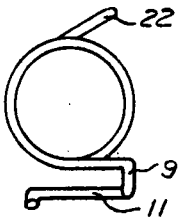

The different portions of the spring F can be formed with different angles to each other due to the demands and field of application. FIGS. 14*a*–16*b* show different embodiments of the spring in its normal positions. Angles $\beta$ and $\gamma$ shown in FIGS. 14*a* and 14*b* provide extra springiness and increased pressure resistance for the contact making parts. FIGS. 14*a* and 14*b* shows a comparatively simple construction. The embodiments of FIGS. 15*a* – 16*b* have good stop locations. The third portion 11 is also provided with a curved end 41 and in the embodiment of FIGS. 16*a* and 16*b*, the first portion is angled.

In accordance with the above shown embodiments, it is important that the elongated member of the spring F terminates separate from the circumference of the current spring layer, either inside or outside the spring.

The invention is not limited to the embodiment specifically shown, but can be subjected to modifications within the scope of the following claims.

What I claim is:

1. A push button type electrical switch comprising:

a housing, a push button movably supported in said housing, a helical coil spring also supported in said housing and having a first end thereof urged against said push button to maintain said push button normally in a first position, said spring being compressed in response to actuation of said push button from its first position to a second position, at least one fixed contact element also supported in said housing, means connected to said spring at its said first end for selective contacting engagement with said at least one fixed contact element dependent on the position of said push button, and circuit means connected to said spring, whereby actuation of said push button between its said first and second positions selectively opens or closes a circuit between said circuit means and through said spring to said at least one fixed contact element.

2. The switch of claim 1 in which said connected means comprises an extension of said spring.

3. The switch of claim 1 in which said circuit means is connected to said spring at a second end thereof remote from said first end.

4. The switch of claim 2 which further includes means supported in said housing and cooperating with said spring extension to provide a greater amount of resistance to initial actuation of said push button from its said first position and a lesser amount of resistance after said push button has moved a predetermined part of the distance to its said second position.

5. The switch of claim 4 in which said housing supported means comprises a surface over which moves a portion of said spring extension during movement of said push button from its said first position to its said second position.

6. The switch of claim 5 in which said surface comprises a first surface portion which is sloped at an obtuse angle to the axis of said spring and a second surface portion which is angled at a small acute angle to said axis.

7. The switch of claim 1 in which protuberances on both said housing and on said push button are fitted within the center of said spring to support said spring at each end.

8. The switch of claim 1 in which said second end of said spring is provided with an elongated extension portion which extends through said housing to provide said circuit means.

9. The switch of claim 2 in which at least a portion of said spring extension is linear and selectively contacts said at least one fixed contact element which also over at least that portion which contacts said spring extension portion is linear.

10. The switch of claim 5 in which said spring extension comprises a first portion which extends perpendicular to the axis of said spring, a second portion connected to said first portion and extending substantially parallel to the spring axis, and a third portion connected to said second portion and forming an angle with said second portion, said third portion moving over said surface of said means supported in said housing.

11. The switch of claim 10 in which said at least one fixed contact element comprises a pair of linearly extending wires which lie in spaced parallel relationship to each other on said surface of said housing supported means to selectively contact said third portion of said spring extension.

12. The switch of claim 1 in which a light-emitting diode is supported within the coils forming said spring.

13. A key set comprising:

a. a first plurality of conductors formed in parallel rows, b. a second plurality of conductors formed in parallel columns, c. a plurality of push button switches each associated with a single conductor of a selected row and a single conductor of a selected column, each said push button switch comprising:

a. a housing, b. a push button movably supported in said housing, c. a helical coil spring also supported in said housing and having a first end thereof urged against said push button to maintain said push button normally in a first position, said spring being compressed in response to actuation of said push button from its first condition to a second position, d. first and second fixed contact elements also supported in said housing and being respectively connected with said first and second plurality of conductors, e. means connected to said spring at its said first end for selective contact engagement with said first and second fixed contact elements dependent on the position of said push button, f. and circuit means connected to said spring, whereby actuation of any said push button between its said first and second positions selectively opens or closes a circuit between said circuit means and through said spring to one or the other of said contact elements.

14. A push button type electrical switch comprising:

a housing, a push button movably supported in said housing, a helical coil spring also supported in said housing and having a first end thereof urged against said push button to maintain said push button normally in a first position, said spring being compressed in response to actuation of said push button from its first position to a second position, at least one fixed contact element also supported in said housing, a non-helical extension of said first end of spring, a contoured cam surface for engagement by at least a portion of said spring extension during movement of said push button between its said first and second positions said cam surface having a first portion so angled relative to the direction of movement of said spring extension which engages said cam surface to provide a relatively high resistance force to actuation of said push button between its first and second positions, said cam surface having a second portion so angled relative to said direction of movement to provide a substantially lesser resistance to said actuation of said push button.

* * * * *